US009377034B2

(12) United States Patent
Horii

(10) Patent No.: US 9,377,034 B2
(45) Date of Patent: Jun. 28, 2016

(54) WORK MACHINE

(71) Applicant: KUBOTA CORPORATION, Osaka (JP)

(72) Inventor: Hiroshi Horii, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 318 days.

(21) Appl. No.: 14/239,361

(22) PCT Filed: Dec. 11, 2012

(86) PCT No.: PCT/JP2012/081994

§ 371 (c)(1),
(2) Date: Feb. 18, 2014

(87) PCT Pub. No.: WO2013/190726

PCT Pub. Date: Dec. 27, 2013

(65) Prior Publication Data

US 2014/0208734 A1 Jul. 31, 2014

(30) Foreign Application Priority Data

Jun. 19, 2012 (JP) ..... 2012-137814

(51) Int. Cl.

| | |
|---|---|
| ***F15B 11/16*** | (2006.01) |
| ***F15B 13/02*** | (2006.01) |
| ***E02F 3/96*** | (2006.01) |
| ***E02F 9/22*** | (2006.01) |
| ***F15B 7/00*** | (2006.01) |

(52) U.S. Cl.

CPC ..... *F15B 13/026* (2013.01); *E02F 3/964* (2013.01); *E02F 9/2225* (2013.01); (Continued)

(58) Field of Classification Search

CPC ..... F15B 11/163; F15B 7/003; F15B 13/026; E02F 9/2225; E02F 9/2239; E02F 9/2282; E02F 9/2292; E02F 9/2296

USPC ..... 60/420

See application file for complete search history.

(56) References Cited

U.S. PATENT DOCUMENTS

| | | | | |
|---|---|---|---|---|
| 4,945,723 | A | 8/1990 | Izumi | |
| 7,571,558 | B2 * | 8/2009 | Horii | E02F 9/2239 37/348 |

(Continued)

FOREIGN PATENT DOCUMENTS

| | | |
|---|---|---|
| CN | 1031270 | 2/1989 |
| CN | 101158167 | 4/2008 |

(Continued)

OTHER PUBLICATIONS

Copending U.S. Appl. No. 14/661,285, filed Mar. 18, 2015.

(Continued)

*Primary Examiner* — Thomas E Lazo

(74) *Attorney, Agent, or Firm* — Greenblum & Bernstein, P.L.C.

(57) ABSTRACT

Provided is a load sensing system for controlling a discharge pressure of the hydraulic pump so as to render a differential pressure obtained by subtracting a maximum load pressure among the hydraulic actuators from a discharge pressure of the hydraulic pump to be a constant pressure, and there are provided: a first load pressure flow passage which introduces load pressures of the hydraulic actuators to be outputted to a PLS transmission line which transmits the maximum load pressure among the hydraulic actuators at the time of activating the hydraulic actuators; and a second load pressure flow passage which is a flow path for introducing the load pressures of the hydraulic actuators to be outputted to the PLS transmission line during operation after activations of the hydraulic actuators, and wherein a flow rate of the pressure oil therein is reduced than that in the first load pressure flow passage.

5 Claims, 6 Drawing Sheets

(52) U.S. Cl.
CPC ..... *E02F 9/2239* (2013.01); *E02F 9/2282* (2013.01); *E02F 9/2285* (2013.01); *E02F 9/2292* (2013.01); *E02F 9/2296* (2013.01); *F15B 7/003* (2013.01); *F15B 11/163* (2013.01); *F15B 2211/20546* (2013.01); *F15B 2211/253* (2013.01); *F15B 2211/30555* (2013.01); *F15B 2211/6051* (2013.01); *F15B 2211/651* (2013.01); *F15B 2211/652* (2013.01); *F15B 2211/7135* (2013.01); *F15B 2211/8613* (2013.01)

(56) References Cited

U.S. PATENT DOCUMENTS

| | | | | |
|---|---|---|---|---|
| 7,743,611 | B2 * | 6/2010 | Horii | E02F 9/2239 60/421 |
| 7,818,968 | B2 * | 10/2010 | Umezu | F15B 11/055 60/468 |
| 2008/0078174 | A1 | 4/2008 | Horii | |
| 2008/0173014 | A1 | 7/2008 | Umezu | |
| 2009/0077839 | A1 | 3/2009 | Horii | |

FOREIGN PATENT DOCUMENTS

| | | |
|---|---|---|
| CN | 101230869 | 7/2008 |
| CN | 101397801 | 4/2009 |
| EP | 2 431 538 | 3/2012 |
| JP | 2006-161510 | 6/2006 |
| JP | 2011-196439 | 10/2011 |
| JP | 2012-067459 | 4/2012 |

OTHER PUBLICATIONS

PCT Search Report and Written Opinion issues in PCT/JP2010/081994.

Chinese Office Action issued in Chinese application 20120035251.2 and dated May 5, 2015.

* cited by examiner

WORK MACHINE

TECHNICAL FIELD

The present invention relates to a working machine such as a back hoe provided with a load sensing system.

BACKGROUND ART

As a working machine provided with a load sensing system, there has been a back hoe described in Patent Literature 1.

In this back hoe, there are equipped a plurality of hydraulic actuators and a main pump composed of a variable displacement hydraulic pump for supplying pressure oil to these hydraulic actuators.

The load sensing system is provided with: direction switching valves which are provided in correspondence with the respective hydraulic actuators to control a supply direction of the pressure oil discharged from the main pump and supply the pressure oil to the hydraulic actuators; and pressure compensation valves provided in correspondence with the respective direction switching valves functioning so as to keep a front and rear differential pressure of each of the direction switching valves.

Further, the load sensing system is provided with a flow rate control part for controlling the main pump, in addition to the variable displacement main pump, direction switching valves and pressure compensation valves, and further includes a PPS transmission line for transmitting a discharge pressure of the main pump as a PPS signal pressure to the flow rate control part and a PLS transmission line for transmitting a maximum load pressure among load pressures of the hydraulic actuators as a PLS signal pressure to the flow rate control part.

The flow rate control part controls the discharge pressure of the main pump so as to maintain the differential pressure obtained by subtracting the PLS signal pressure from the PPS signal pressure to be a constant pressure.

In the case where the plurality of hydraulic actuators are operated, the load sensing system diverts the discharge flow rate of the main pump so as to supply the pressure oil to each of operated hydraulic cylinders by a quantity corresponding to an operated amount regardless of difference in value of loads acting on the operated hydraulic actuators.

The pressure compensation valve is provided with a load pressure flow passage for introducing a load pressure of a hydraulic actuator corresponding to the pressure compensation valve and outputting the load pressure to the PLS transmission line.

CITATION LIST

Patent Literature

Patent Literature 1: Japanese Unexamined Patent Publication JP-A2012-67459

SUMMARY OF INVENTION

Technical Problem

In a back hoe, in a case of continuously performing rapid operations during a working such as a drilling, an operating oil flow rate is suddenly changed and a machine body may likely act violently due to an operation change of a control target of a hydraulic actuator. For the purpose of such a case, conventionally, a certain amount of a diaphragm is adopted in a load pressure flow passage of a pressure compensation valve. By providing the diaphragm in the load pressure flow passage for introducing a load pressure of the hydraulic actuator, a detection sensitivity of the PLS signal pressure is dulled and control responsibility of the main pump is made slow, whereby stability of the machine body can be increased.

However, on the other hand, when the control target of the hydraulic actuator is activated, although it is desired to be quickly activated, the signal responsibility is reduced due to an effect of the diaphragm and the responsibility at the time of activation becomes slow.

Therefore, in consideration of the above problem, the present invention has an object to provide a working machine capable of exerting quick responsibility at the time of activating the hydraulic actuator and increasing the stability of the machine body during the actuation after the hydraulic actuator is activated.

Solution to Problem

Technical means made by the present invention for solving the problem have specific features as following.

In a first aspect of the present invention, a working machine includes:

a plurality of hydraulic actuators;

a variable displacement hydraulic pump for supplying pressure oil to these hydraulic actuators; and a load sensing system for controlling a discharge pressure of the hydraulic pump so as to render a differential pressure obtained by subtracting a maximum load pressure among the hydraulic actuators from a discharge pressure of the hydraulic pump to be a constant pressure, wherein the working machine is provided with: a first load pressure flow passage which introduces load pressures of the hydraulic actuators to be outputted to a PLS transmission line which transmits the maximum load pressure among the hydraulic actuators at the time of activating the hydraulic actuators; and a second load pressure flow passage which is a flow path for introducing the load pressures of the hydraulic actuators to be outputted to the PLS transmission line during operation after activations of the hydraulic actuators, and wherein a flow rate of the pressure oil therein is reduced than that in the first load pressure flow passage.

In a second aspect of the present invention, the working machine includes:

direction switching valves provided in correspondence with the respective hydraulic actuators, the direction switching valves controlling supply directions of the pressure oil discharged from the hydraulic pump to supply the pressure oil to the hydraulic actuators; and pressure compensation valves functioning so as to maintain differential pressures before and behind the direction switching valves to be constant, the pressure compensation valves provided in correspondence with the respective direction switching valves, wherein the pressure compensation valve is provided with the first load pressure flow passage and the second load pressure flow passage, whereby the first load pressure flow passage functions from a beginning of a stroke to a middle of the stroke of the pressure compensation valve and the second load pressure flow passage functions at a time of a full stroke of the pressure compensation valve.

In a third aspect of the present invention, a diaphragm is provided in the second load pressure flow passage without providing a diaphragm in the first load pressure flow passage, whereby a flow rate of the pressure oil of the second load pressure flow passage is reduced lower than that of the first load pressure flow passage.

In a fourth aspect of the present invention, diaphragms are provided in both of the first load pressure flow passage and the second load pressure flow passage and a flow path opening area of the diaphragm of the second load pressure flow passage is made smaller compared to a flow path opening area of the diaphragm of the first load pressure flow passage, whereby a flow rate of the pressure oil of the second load pressure flow passage is reduced lower than that of the first load pressure flow passage.

In a fifth aspect of the present invention, the pressure compensation valve is provided with a load pressure-introduction port introducing the load pressures of the hydraulic actuators and a load pressure outlet port outputting the load pressures of the hydraulic actuators introduced from this load pressure introduction port to the PLS transmission line, wherein the load pressure introduction port and the load pressure outlet port are communicated through the first load pressure flow passage from a beginning of a stroke to a middle of the stroke of the pressure compensation valve, and the communication is switched at the middle of the stroke and thereafter, the load pressure introduction port and the load pressure outlet port are communicated through the second load pressure flow passage.

Advantageous Effects of Invention

According to the invention, the following effects are exerted.

According to the first aspect of the present invention, at the time of activating the hydraulic actuator, since the load pressure of the hydraulic actuator is transmitted to the PLS transmission line via the first load pressure flow passage having a pressure oil flow rate larger than that of the second load pressure flow passage, the control responsibility of the hydraulic pump is high and the control pressure instantly follows to thereby exert quick responsibility.

Moreover, during the actuation after activating the hydraulic actuator, since the load pressure of the hydraulic actuator is transmitted to the PLS transmission line via the second load pressure flow passage having a flow rate restricted lower than that of the first load pressure flow passage, the transmission responsibility of the PLS signal pressure becomes slow by the second load pressure flow passage and the stability of the machine body of the working machine can be increased by suppressing a following performance of the control pressure to the hydraulic pump.

According to the second aspect of the present invention, by incorporating the first load pressure flow passage and second load pressure flow passage into the pressure compensation valve, the structure can be simplified.

According to the third aspect of the present invention, the load pressure of the hydraulic actuator is transmitted by a flow path having no diaphragm at the time of activating the hydraulic actuator and the load pressure of the hydraulic actuator is transmitted by the flow path having a diaphragm during an actuation after activating the hydraulic actuator, whereby it is possible to easily carry out the working machine capable of exerting quick responsibility at the time of activating the hydraulic actuator and increasing the stability of the machine body during the actuation after activating the hydraulic actuator.

According to the fourth aspect of the present invention, the load pressure of the hydraulic actuator is transmitted by the flow path having the large diaphragm at the time of activating the hydraulic actuator and the load pressure of the hydraulic actuator is transmitted by the flow path having the small diaphragm during an actuation after activating the hydraulic actuator, whereby it is possible to easily carry out the working machine capable of exerting quick responsibility at the time of activating the hydraulic actuator and increasing the stability of the machine body during the actuation after activating the hydraulic actuator.

According to the fifth aspect of the present invention, the pressure compensation valve is provided with the load pressure introduction port and the load pressure outlet port and these ports are communicated through the first load pressure flow passage from the beginning of the stroke to the middle of the stroke of the pressure compensation valve, and the communication is switched at the middle of the stroke and thereafter these ports are communicated through the second load pressure flow passage, whereby it is possible to easily realize the working machine capable of exerting quick responsibility at the time of activating the hydraulic actuator and increasing the stability of the machine body during the actuation after activating the hydraulic actuator

DESCRIPTION OF EMBODIMENTS

The following describes an embodiment of the present invention with reference to the drawings.

Figure 5:
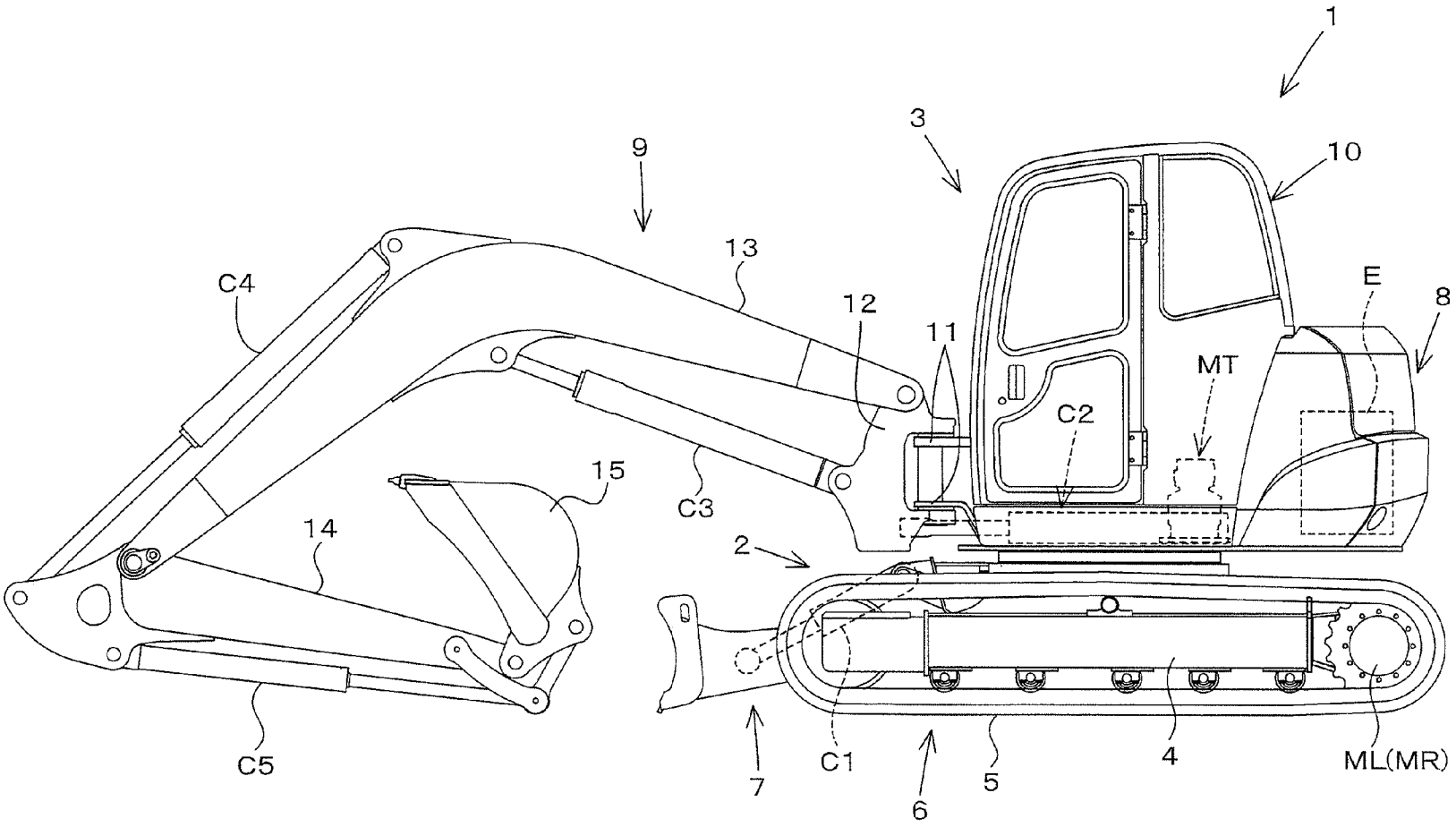
FIG. 5 is a side view of a back hoe.

In FIG. 5, reference numeral 1 denotes a back hoe exemplified as a working machine.

This back hoe 1 is mainly configured of a lower part traveling body 2 and an upper part rotating body 3 mounted on this traveling body 2 so as to be freely rotatable about a vertical rotating axis center.

The traveling body 2 includes crawler type traveling devices 6 respectively provided on both left and right sides of a truck frame 4, the crawler type traveling devices 6 being configured to rotate crawler belts 5 in circulation in circumferential directions by traveling motors ML and MR each composed of a hydraulic motor.

A dozer device 7 is provided on a front portion of the truck frame 4, and a blade of this dozer device 7 is made movable up and down by expansion and contraction of a dozer cylinder C1 which is composed of a hydraulic cylinder.

The rotating body 3 is mounted on the truck frame 4 so as to be freely rotatable about the rotating axis center, and includes a rotating base 8 which configures a machine body, a front working device 9 (digging working device) provided on a front portion of this rotating base 8 and a cabin 10 mounted on the rotating base 8.

The rotating base 8 is provided with an engine E, a radiator, a fuel tank, an actuation oil tank, a battery and the like, wherein the rotating base 8 is made rotatably driven by a rotating motor MT composed of a hydraulic motor.

Further, on a front portion of the rotating base 8, there is provided a swing bracket 12 which is supported on a supporting bracket 11 so as to be laterally swingable about a vertical axis center, the supporting bracket 11 being provided in a state of protruding frontward from the rotating base 8. This swing bracket 12 is made laterally swing-operable by expansion and contraction of a swing cylinder C2 composed of a hydraulic cylinder.

The front working device 9 is mainly composed of: a boom 13 with its proximal side pivotally connected to an upper portion of the swing bracket 12 so as to be freely rotatable about a lateral axis and to be freely swingable vertically; an arm 14 with its proximal side pivotally connected to a tip end side of this boom 13 so as to be freely rotatable about a lateral axis and to be freely swingable back and forth; and a bucket 15 pivotally connected to a tip end side of this arm 14 so as to be freely rotatable about a lateral axis and to be freely swingable back and forth.

The boom 13 is moved upward by extending a boom cylinder C3 interposed between the boom 13 and the swing bracket 12, and is moved downward by contracting the boom cylinder C3.

The arm 14 is swung backward to perform a crowd operation (raking operation) by extending an arm cylinder C4 interposed between the arm 14 and the boom 13, and is swung frontward to perform a dump operation by contracting the arm cylinder C4.

The bucket 15 is swung backward to perform a crowd operation (scooping operation) by extending a bucket cylinder C5 interposed between the bucket 15 and the arm 14 and is swung frontward to perform a dump operation by contracting the bucket cylinder C5.

Each of the boom cylinder C3, arm cylinder C4 and bucket cylinder C5 is composed of a hydraulic cylinder.

Next, a hydraulic system for actuating various kinds of hydraulic actuators ML, MR, MT and C1 to C5 equipped in the back hoe 1 is described with reference to FIGS. 1 to 4.

Figure 2:
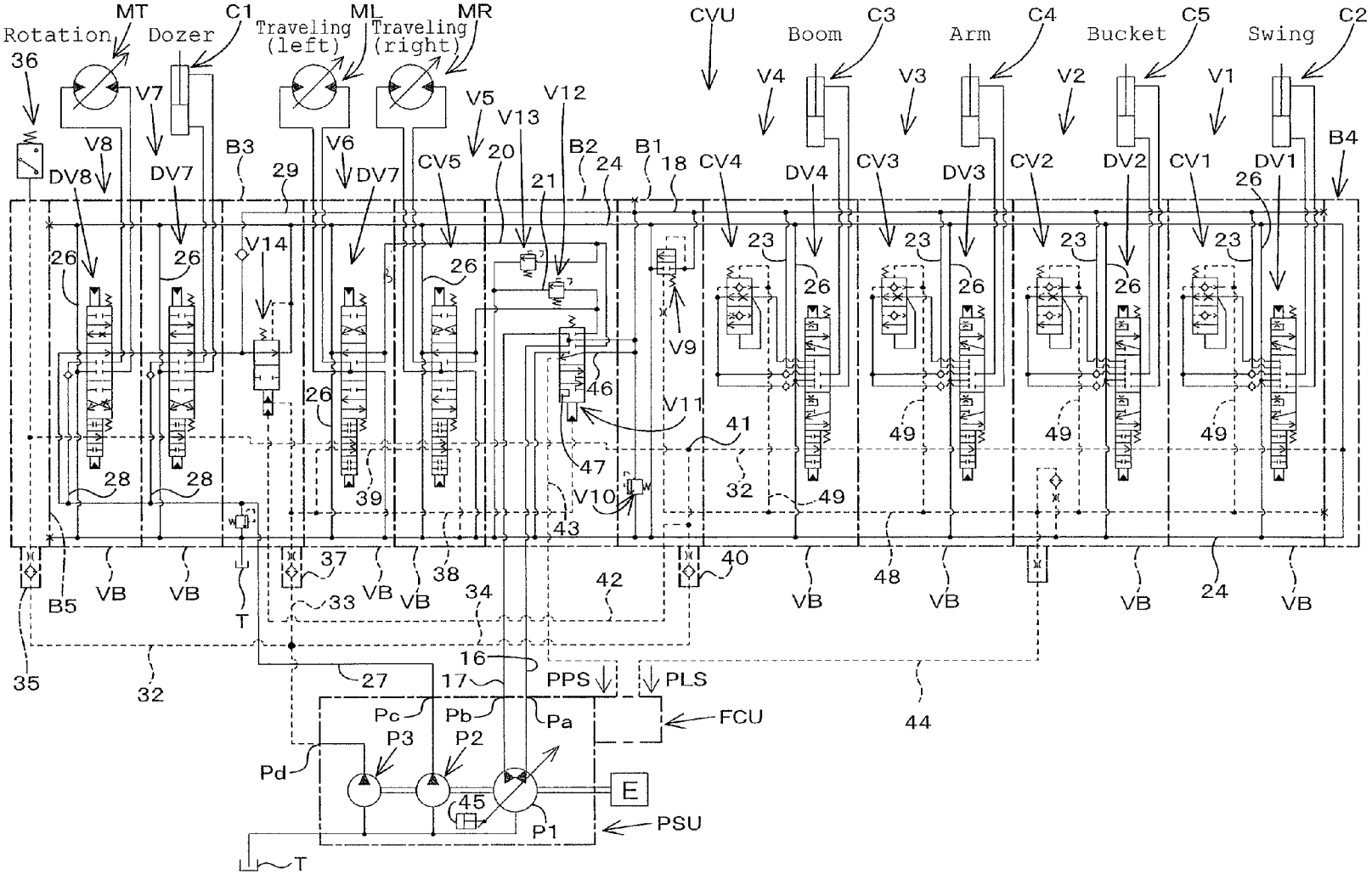
FIG. 2 is a hydraulic circuit diagram showing an entire configuration.

As shown in FIG. 2, the hydraulic system includes a pressure oil supply unit PSU, a control valve CVU and a flow rate control part FCU.

The pressure oil supply unit PSU is provided with: first to third pumps P1, P2 and P3 composed of hydraulic pumps driven by the engine E; and first to fourth discharge ports Pa, Pb, Pc and Pd for outputting the pressure oil discharged from the first to third pumps P1, P2 and P3.

The first pump P1 (main pump) is a swash plate type variable displacement axial pump and is composed of an equal flow rate double pump (sprit-flow type hydraulic pump) capable of obtaining equal discharge quantities from independent two discharge ports. The pressure oil discharged from one of the discharge ports of this first pump P1 is outputted from the first discharge port Pa and the pressure oil discharged from the other discharge port of the first pump P1 is outputted from the second discharge port Pb.

Each of the second pump P2 and the third pump P3 is composed of a fixed displacement gear pump, and the pressure oil discharged from the second pump P2 is outputted from the third discharge port Pc, and the pressure oil discharged from the third pump P3 is outputted from the fourth discharge port Pd.

The pressure oil discharged from the first pump P1 is used for the traveling motors ML and MR, hydraulic cylinders C3, C4, C5 and swing cylinder C2 of the front working device 9, the pressure oil discharged from the second pump P2 is mainly used for the rotating motor MT and dozer cylinder C1 and is also used for the boom cylinder C3, arm cylinder C4, bucket cylinder C5 and swing cylinder C2 as well, and the pressure oil discharged from the third pump P3 is used for supplying a signal pressure such as a pilot pressure and a detection signal and the like.

It is noted that the first pump 21 may possibly be composed of separately configured two pumps.

The control valve CVU is composed by arranging the control valves V1 to V8 for controlling various kinds of hydraulic actuators ML, MR, MT and C1 to C5, first to third intermediate blocks B1 to B3 and first and second edge blocks B4 and B5 in one direction to be put together.

In FIG. 2, V1 is a swing control valve for controlling the swing cylinder C2, V2 is a bucket control valve for controlling the bucket cylinder C5, V3 is an arm control valve for controlling the arm cylinder C4, V4 is a boom control valve for controlling the boom cylinder C3, V5 is a right side traveling control valve for controlling the right-side traveling motor MR, V6 is a left side traveling control valve for controlling the left-side traveling motor ML, V7 is a dozer control valve for controlling the dozer cylinder C1, and V8 is a rotating control valve for controlling the rotating motor MT.

These control valves V1 to V8 are arranged from the right toward the left in FIG. 2 in the order of the explanation described above.

In FIG. 2, the control valves V1 to V8 have respectively directional switching valves DV1 to DV8 incorporated inside their valve bodies VB for switching the directions of the pressure oil, and further in the swing control valve V1, bucket control valve V2, arm control valve V3 and boom control valve V4, pressure compensation valves (compensator valves) CV1 to CV4 are incorporated inside the valve bodies VB for functioning as adjustments of loads between these cylinders C2 to C5 when using a plurality of ones among the boom cylinder C3, arm cylinder C4, bucket cylinder C5 and swing cylinder C2.

Each of the directional switching valves DV1 to DV8 is composed of a direct operated spool type switching valve and is also composed of a pilot operation switching valve which is switch-operated by a pilot pressure. Further, the spool of each of the directional switching valves DV1 to DV8 is moved in proportion to an operating amount of each operating means for pilot-operating each of the directional switching valves DV1 to DV8, and it is configured that the pressure oil of a quantity proportional to the movement amount of each of the directional switching valves DV1 to DV8 is supplied to each of the control targeted hydraulic actuators ML, MR, MT and C1 to C5, whereby an actuating speed of an operation target (control target) is made variable in proportion to the operating amount of each operating means.

Figure 3:
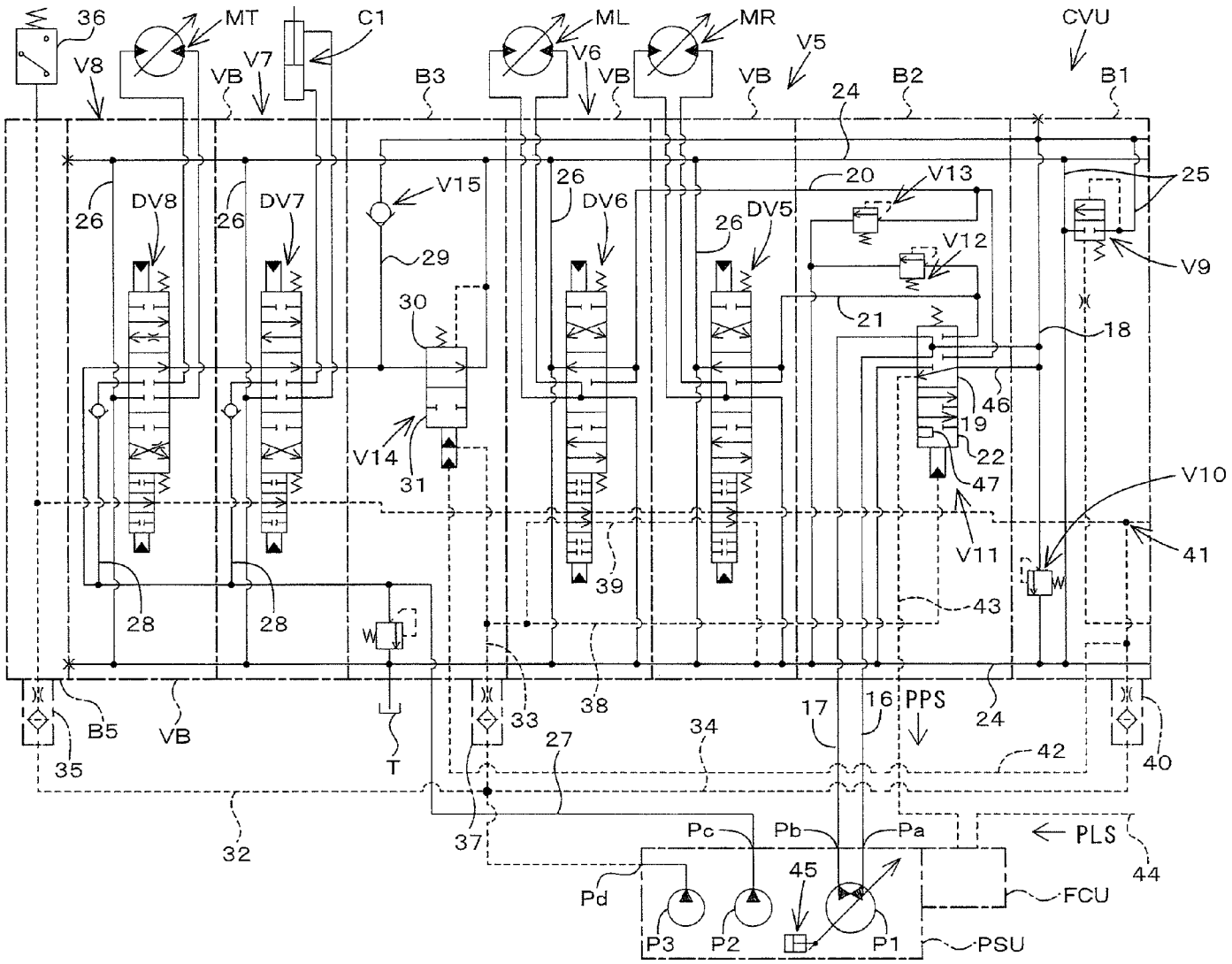
FIG. 3 is a hydraulic circuit diagram showing a left half of the hydraulic circuit of FIG. 2.

As shown in FIGS. 2 and 3, the first intermediate block B1 is provided therein with an unload valve V9 with its spool urged to a closing direction by a spring and a main relief valve V10 of the first pump P1, the second intermediate block B2 is provided therein with a first flow path switching valve V11 composed of a direct operate spool type pilot operation switching valve and relief valves V12 and V13 for traveling control valve V5 and V6, and the third intermediate block B3 is provided therein with a second flow path switching valve V14 composed of a direct operated spool type pilot operation switching valve.

The first intermediate block B1 is interposed between the boom control valve 4 and the second intermediate block B2, the second intermediate block B2 is interposed between the right side traveling control valve V5 and the first intermediate block B1, and the third intermediate block B3 is interposed between the left side traveling control valve V6 and the dozer control valve V7.

The first edge block B4 is connected to the swing control valve V1, and the second edge block B5 is connected to the rotating control valve V8.

The first flow path switching valve V11 is connected with the discharge port Pa via a first discharge path 16 and is also connected with the second discharge port Pb via a second discharge path 17.

The first flow path switching valve V11 is rendered to be freely switchable between a confluent position 19 where the first discharge path 16 and second discharge path 17 are connected to a front working system supply line 18 for supplying pressure oil to the boom control valve 4, arm control valve V3, bucket control valve V2 and swing control valve V1 and an independent supply position 22 where the first discharge path 16 is connected to a traveling left supply path 20 for supplying pressure oil to the left side traveling control valve V6 and the second discharge path 17 is connected to a traveling right supply path 21 for supplying pressure oil to the right side traveling control valve V5, wherein the first flow path switching valve V11 is switched to the confluent position 19 by a spring and switched to the independent supply position 22 by a pilot pressure.

The front working system supply line 18 is provided extending from the first intermediate block B1 to each of the valve bodies VB of the boom control valve 4, arm control valve V3, bucket control valve V2 and swing control valve V1, while one end is connected to the main relief valve V10 and the other end is closed.

Further, this front working system supply line 18 is connected to each of the directional switching valves DV1 to DV4 of the swing control valve V1, bucket control valve V2, arm control valve V3 and boom control valve V4 via respective actuating oil supply paths 23.

Further, the control valve CVU is provided with a drain line 24 extending from the first edge block B4 to the rotating control valve V8.

This drain line 24 is connected with the front working system line 18 via a connecting oil path 25 and the unload valve V9, and is also connected with each of the directional switching valves DV1 to DV8 of the control valves V1 to V8 via a drain oil path 26.

The second flow path switching valve V14 is connected with a third discharge path 27 which is extended from the third discharge port Pc and sequentially passes through the directional switching valve DV8 of the rotating control valve V8 and the directional switching valve DV7 of the dozer control valve V7, and this third discharge path 27 is connected with a supply path 28 for supplying pressure oil to each of the rotating and dozer control valves.

Further, one end of a connecting path 29 is connected to an upstream side of the second flow path switching valve V14 of the third discharge path 27 and a downstream side of the dozer control valve V7 and the other end of this connecting path 29 is connected to the front working system supply line 18. Further, in this connecting path 29, there is interposed a check valve V15 for preventing backflow of the pressure oil from the side of the front working system supply line 18.

The second flow path switching valve V14 is rendered to be freely switchable between a non-supply position 30 where pressure oil from the second pump P2 is not supplied to the front working system supply line 18 by connecting the third discharge path 27 to the drain line 24 and a supply position 31 where discharge oil from the second pump P2 is supplied to the front working system supply line 18 via the connecting path 29 by blocking the communication between the third discharge path 27 and the drain line 24, and the switching to the non-supply position 30 is performed by a spring and the switching to the supply position 31 is performed by a pilot pressure.

The pressure oil outputted from the fourth discharge port Pd is diverted into a valve operation detection line 32, a first pilot pressure supply path 33 and a second pilot pressure supply path 34.

The valve operation detection line 32 is connected to the drain line 24 via a first signal pressure introduction part 35 provided in the second edge block→the directional switching valve DV8 of the rotating control valve V8→the directional switching valve DV7 of the dozer control valve V7→the directional switching valve DV6 of the left side traveling control valve V6→the directional switching valve DV5 of the right side traveling control valve V5→the directional switching valve DV4 of the boom control valve V4→the directional switching valve DV3 of the arm control valve V3→the directional switching valve DV2 of the bucket control valve V2→the directional switching valve DV1 of the swing control valve V1.

An AI switch 36 composed of a pressure switch is connected between the first signal pressure introduction part 35 of this valve operation detection line 32 and the rotating control valve V8, and it is configured that, by operating any of the control valves V1 to V8 from a neutral position, a partial portion of the valve operation detection line 32 is blocked and there arises a pressure on the valve operation detection line 32 and this pressure is detected by the AI switch 36.

A revolution number of the engine E is automatically controlled such that, in the case where there is no pressure detected by this AI switch 36, the revolution number of the engine E is automatically lowered down to an idling revolution and in the case where there is a, pressure detected by the AI switch 36, the revolution number of the engine E is automatically controlled so that the revolution number of the engine E is automatically raised up to a predetermined revolution number.

The first pilot pressure supply path 33 is introduced to the third intermediate block B3 from the second signal pressure introduction part 37 and connected to a pilot pressure receiving part of the second flow path switching valve V14, and one end of the first flow path switching oil path 38 is connected to this first pilot pressure supply path 33 and the other end of this first flow path switching oil path 38 is connected to a pilot pressure receiving part of the first flow path switching valve V11.

Further, one end side of a traveling detection line 39 is connected to the first flow path switching oil path 38 and the other end side of this traveling detection line 39 is connected to the drain line 24 via the directional switching valve DV6 of the left side traveling control valve→the directional switching valve DV5 of the right side traveling control valve.

The second pilot pressure supply path 34 is introduced to the first intermediate block B1 from the third signal pressure introduction part 40 and connected, at a connection point 41, to the downstream side of the right side traveling control valve V5 and the upstream side of the boom control valve V4 of the valve operation detection line 32.

One end side of the second flow path switching oil path 42 is connected between this connecting point 41 and the third signal pressure introduction part 40 and the other end side of this second flow path switching oil path 42 is connected to the pilot pressure receiving part of the second flow path switching valve V14.

In the hydraulic system of the present embodiment, in the case where the left and right traveling control valves V6 and V5 are not operated, the first flow path switching valve V11 is switched to the confluent position 19 and the second flow path switching valve V14 is switched to the non-supply position 30, and the discharge oil from the first pump P1 is joined, whereby the pressure oil is allowed to be supplied to the directional switching valves DV1 to DV4 of the respective control valves V1 to V4 for swing, bucket, arm and boom, and the pressure oil from the second pump P2 is drained after passing through the rotating control valve V8 and dozer control valve V7.

In this state, in the case where the left and right traveling valves V6 and V5 are operated, a partial portion of the traveling detection line 39 is blocked and there arises a pressure in the traveling detection line 39 and also there arises a pressure in the first flow path switching oil path 38, whereby the first flow path switching valve V11 is switched to the independent supply position 22.

Thus, the discharge oil from the first discharge port Pa is supplied to the left side traveling control valve V6 and the discharge oil from the second discharge port Pb is supplied to the right side traveling control valve V5 but the discharge oil from the first and second discharge ports Pa and Pb is not supplied to the swing, bucket, arm and boom control valves V1 to V4.

In this state, in the case where one or more of the swing control valve V1, bucket control valve V2, arm control valve V3 and boom control valve V4 are operated, the second flow path switching valve V14 is switched to the supply position 31 by a sum of the pressures of the first pilot pressure supply path 33 and the second flow path switching oil path 42, whereby the pressure oil from the second pump P2 is allowed to be supplied to the boom control valve V4, arm control valve V3, bucket control valve V2 and swing control valve V1.

In this hydraulic system, the discharge quantity of the hydraulic pump P1 is controlled in accordance with a load pressures of the hydraulic actuators C2 to C5 and a hydraulic power required for a load is allowed to be discharged from the hydraulic pump P1, whereby a load sensing system capable of improving the saving of the power and operability is adopted.

In the present embodiment, this load sensing system is adapted to be an after-orifice type load sensing system which, in the state of the first flow path switching valve V11 being switched to the confluent position 19, functions so as to control the discharge pressure (discharge quantity) of the first pump P1 for the load pressures of the boom cylinder C3, arm cylinder C4, bucket cylinder C5 and swing cylinder C2, wherein the pressure compensation valves CV1 to CV4 are respectively connected after the spools of the respective directional switching valves DV1 to DV4 of the swing control valve V1, bucket control valve V2, arm control valve V3 and boom control valve 4.

As shown in FIG. 2, this load sensing system includes a PPS transmission line 43 for transmitting a discharge pressure (PPS signal pressure) of the first pump P1 to the flow rate control part FCU and a PLS transmission line 44 for transmitting a maximum load pressure (PLS signal pressure) among the load pressures of the swing cylinder C2, bucket cylinder C5, arm cylinder C4 and boom cylinder C3 to the flow rate control part FCU.

The flow rate control part FCU controls a swash plate control cylinder 45 for controlling a swash plate of the first pump P1 so as to maintain a differential pressure ("PPS signal pressure—PLS signal pressure") obtained by subtracting the PLS signal pressure from the PPS signal pressure to be constant pressure (controlled differential pressure) to thereby control the discharge pressure (discharge quantity) of the first pump P1.

As shown in FIG. 3, the PPS transmission line 43 is connected to the first flow path switching valve V11 and it is connected to the front working system supply line 18 via a connection oil path 46 in a state that the first flow path switching valve V11 is switched to the confluent position 19 to thereby transmit the PPS signal pressure to the flow rate control part FCU.

Further, in the case where the first flow path switching valve V11 is switched to the independent supply position 22, this PPS transmission line 43 is communicated with the drain line 24 via a relief oil path 47 and the PPS signal pressure becomes zero. In this case, a swash plate angle of the first pump P1 becomes maximum and the first pump 21 discharges the maximum flow rate.

As shown in FIG. 2, the PLS transmission line 44 is connected to a load pressure detection line 48 provided in the control valve CVU. The load pressure detection line 48 is provided in a range from the first intermediate block B1 to the valve body VB of the boom control valve 4, valve body VB of the arm control valve V3, valve body VB of the bucket control valve V2 and valve body VB of the swing control valve V1, and one end side is connected to the pilot pressure receiving part in a side of a spring urging the spool of the unload valve V9 to a closing direction while the other end side is closed.

Figure 4:
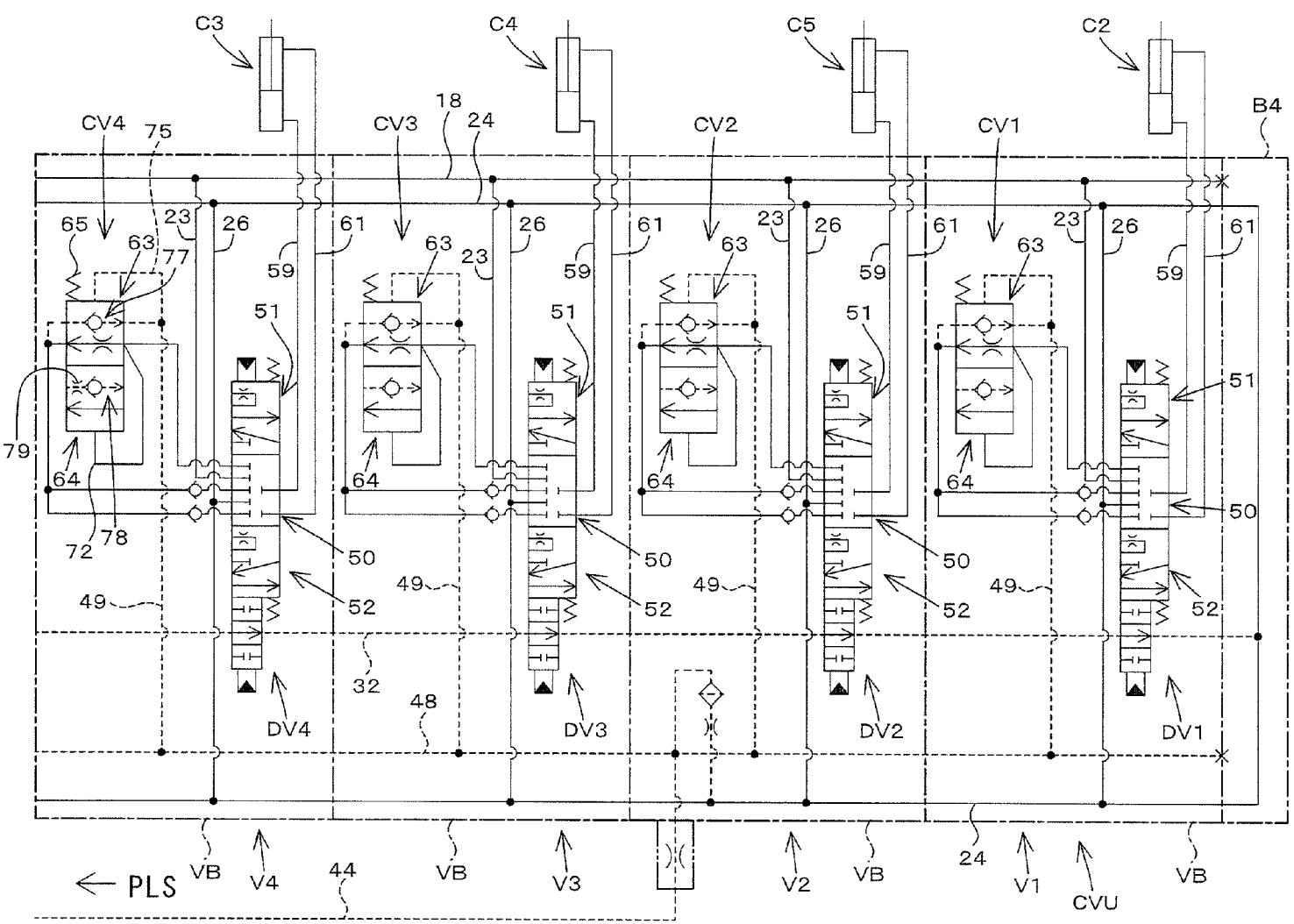
FIG. 4 is a hydraulic circuit diagram showing a right half of the hydraulic circuit of FIG. 2.

As shown in FIG. 4, this load pressure detection line 48 is connected to each of the pressure compensation valves CV1 to CV4 of the swing control valve V1, bucket control valve V2, arm control valve V3 and boom control valve 4, via respective load pressure transmission oil paths 49.

In this load sensing system, the loads acting on the swing cylinder C2, boom cylinder C3, arm cylinder C4 and bucket cylinder C5 are transmitted to the load pressure detection line 48 via the respective load pressure transmission oil paths 49, and the maximum load pressure among the loads acting on the swing cylinder C2, boom cylinder C3, arm cylinder C4 and bucket cylinder 05 is transmitted as the PLS signal pressure to the flow rate control part FCU from the load pressure detection line 48 via the PLS transmission line 44.

Figure 1:
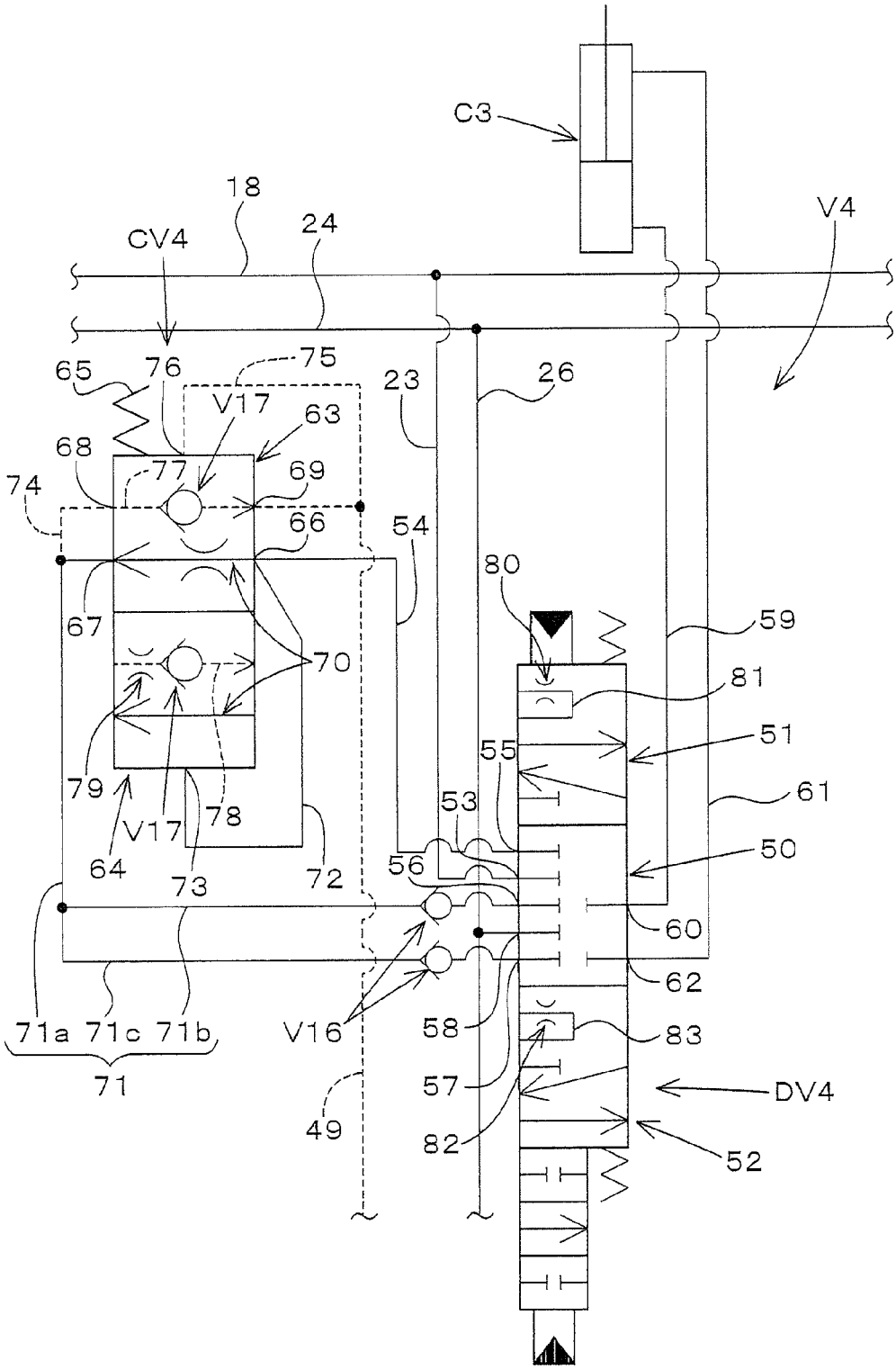
FIG. 1 is a hydraulic circuit diagram of an essential part.

Next, the boom control valve V4 is described in detail with reference to FIG. 1.

Note that, since the arm control valve V3, bucket control valve V2 and swing control valve V1 are configured similarly to the boom control valve 4 except for a partial portion, as to the arm control valve V3, bucket control valve V2 and swing control valve V1, the same reference numerals are appended to the parts similar to the boom control valve 4 and the explanations thereof are omitted.

The directional switching valve DV4 of the boom control valve V4 is rendered to be freely switchable among a neutral position 50, a first switching position 51 which can be switched by moving the spool in one direction from the neutral position 50 and a second switching position 52 which can be switched by moving the spool in the other direction from the neutral position 50.

In the boom control valve V4, the first switching position 51 of the directional switching valve DV4 is rendered to be a boom raise-up position where the boom cylinder C3 is extended to raise up the boom 13, and the second switching position 52 is rendered to be a boom lower-down position where the boom cylinder C3 is contracted to lower down the boom 13.

This directional switching valve DV4 of the boom control valve V4 includes: a pump port 53 which is connected with the actuating oil supply path 23; an output port 55 which is connected with an actuating oil sending flow path 54 for flowing the actuating oil from the first pump P1 to the pressure compensation valve CV4; first input port 56 and second input port 57 for inputting the actuating oil supplied from the first pump 21 and passed through the pressure compensation valve CV4; a drain port 58 communicating with the drain line 24; a first actuator port 60 connected to a bottom side chamber of the boom cylinder C3 via a first actuator oil path 59 and a second actuator port 62 connected to a head side oil chamber of the boom cylinder C3 via a second actuator oil path 61.

The pressure compensation valve CV4 is composed of a direct operated spool type switching valve and it is rendered to be freely slidable from a stroke start-edge position 63 (neutral position) to a full stroke position 64 by moving the spool in one direction from the stroke start-edge position 63, wherein the spool is urged by a return spring 65 in a direction capable of switching to the stroke start-edge position 63.

This pressure compensation valve CV4 includes: an actuating oil inlet port 66 which is connected with the actuating oil sending flow path 54 and is communicated with the output port 55 of the directional switching valve DV4; an actuating oil outlet port 67 which is communicated with this actuating oil inlet port 66; a load pressure introduction port 68 to which a load of the boom cylinder C3 is introduced and a load pressure outlet port 69 which is communicated with this load pressure introduction port 68.

An actuating oil flow passage 70, which is formed in the spool of this pressure compensation valve CV4 and communicates between the actuating oil inlet port 66 and the actuating oil outlet port 67, is throttled at the stroke start-edge position 63 and it is configured so that a flow path opening area is gradually increased as the spool moves from the stroke start-edge position 63 to the full stroke position 64.

The actuating oil outlet port 67 is communicated with the first input port 56 and second input port 57 of the directional switching valve DV4 via a communicating path 71. The communicating path 71 is composed of a first flow path 71*a* having its one end side connected to the actuating oil outlet port 67, and a second flow path 71*b* and third flow path 71*c* each of which has one end side connected to the other end side of this first flow path 71*a*. The other end side of the second flow path 71*b* is connected to the first input port 56 and the other end side of the third flow path 71*c* is connected to the second input port 57.

In the first flow path 71*a* and second flow path 71*b*, there are respectively interposed check valves V16 for preventing backflows of the pressure oil from the first and second input ports 56 and 57 to the actuating oil outlet port 67.

The actuating oil sending oil path 54 (actuating oil inlet port 66) is connected with one end side of a first spool actuating oil path 72, and the other end side of this first spool actuating oil path 72 is connected to a pressure receiving part 73 in an opposite side to a side where the return spring 65 of the spool of the pressure compensation valve CV4 is provided.

The load pressure introduction port 68 is connected with one end side of a load pressure introduction path 74, and the other end side of this load pressure introduction path 74 is connected to the first flow path 71*a* of the communicating path 71.

The load pressure outlet port 69 is connected with the load pressure transmission oil path 49 to transmit a load pressure of the boom cylinder C3 to the load pressure detection line 48 (to output a load pressure of the boom cylinder C3 to the PLS transmission line 44).

Further, the load pressure transmission oil path 49 is connected with one end side of a second spool actuating oil path 75, and the other end side of this second spool actuating oil path 75 is connected to a pressure receiving part 76 in the same side as a side where the return spring 65 of the spool of the pressure compensation valve CV4 is provided.

A pressure oil path, which is formed in the spool of the pressure compensation valve CV4 to communicate the load pressure introduction port 68 and the load pressure outlet port 69, is composed of a first load pressure flow passage 77 which communicates the load pressure introduction port 68 and the load pressure outlet port 69 at the stroke start-edge position 63 and a second load pressure flow passage 78 which communicates the load pressure introduction port 68 and the load pressure outlet port 69 at the full stroke position 64.

In each of the load pressure flow passages 77 and 78, there is interposed a check valve V17 which prevents a backflow of the pressure oil from the load pressure outlet port 69 to the load pressure introduction port 68, wherein a diaphragm 79 is interposed in an upstream side of the check valve V17 of the second load pressure flow passage 78 but there is provided no diaphragm in the first load pressure flow passage 77.

Further, the switching from the first load pressure flow passage 77 to the second load pressure flow passage 78 is performed in the midway of moving the spool of the pressure compensation valve CV4 from the stroke start-edge position 63 to the full stroke position 64. In the present embodiment, it is configured that, for example, the maximum stroke of the spool is defined to be 8mm, and when the stroke of the spool is 0 to 6 mm, the load pressure introduction port 68 and the load pressure outlet port 69 are communicated through the first load pressure flow passage 77, and when the stroke of the spool is 6 to 8 mm, the load pressure introduction port 68 and the load pressure outlet port 69 are communicated through the second load pressure flow passage 78.

The difference in configuration of the boom control valve V4 from the swing control valve V1, bucket control valve V2 and arm control valve V3 resides in a point that "the pressure compensation valve CV4 is provided with the second load pressure flow passage 78 having a diaphragm interposed therein, and the switching from the first load pressure flow passage 77 to the second load pressure flow passage 78 is performed in the midway of moving the spool of the pressure compensation valve CV4 from the stroke start-edge position 63 to the full stroke position 64". That is, only the first load pressure flow passage 77 is provided in the pressure compensation valves CV1 to CV3 of the swing control valve V1, bucket control valve V2 and arm control valve V3, and the first load pressure flow passage 77 communicates between the load pressure introduction port 68 and the load pressure outlet port 69 over a range from the stroke start-edge to the full stroke. The other points are coincident in configuration between the boom control valve V4 and the swing control valve V1, bucket control valve V2 and arm control valve V3.

In the boom control valve V4, arm control valve V3, bucket control valve V2 and swing control valve V1 of the configuration described above, in the case where the directional switching valves DV1 to DV4 exist in the neutral position 50, the pump port 53 and the output port 55 are rendered not to be communicated and there flows no actuating oil in the pressure compensation valves CV1 to CV4 and the pressure compensation valves CV1 to CV4 are positioned at the stroke start-edge position 63. Further, the first and second input ports 56 and 57 and the first and second actuator ports 60 and 62 are rendered to be non-connected.

In the case where the spools of the directional switching valves DV1 to DV4 are moved to the direction to be switched from the neutral position 50 to the first switching position 51, the pump port 53 and the output port 55 are connected through a first connecting oil path 81 having a diaphragm 80 interposed therein and the first input port 56 is connected to the first actuator port 60 and the second actuator port 62 is connected to the drain port 58.

Then, the pressure oil from the first pump P1 is supplied to bottom side oil chambers of the cylinders C2 to C5 via the actuating oil sending oil path 54→actuating oil flow passage 70→first flow path 71*a* of the communicating path 71→second flow path 71*b* of the communicating path 71→first actuator oil path 59, and the oil in the head side oil chambers of the cylinders C2 to C5 is discharged to flow into the drain line 24 to perform a raising operation in the case of the boom 13, to perform a raking operation in the case of the arm 14, to perform a scooping operation in the case of the bucket 15 and to perform a swinging operation in one of the left and right sides in the case of the swing bracket 12.

In the case where the spools of the directional switching valves DV1 to DV4 are moved to the direction to be switched from the neutral position 50 to the second switching position 52, the pump port 53 and the output port 55 are connected through a second connecting oil path 83 having a diaphragm 82 interposed therein and the second input port 57 is connected to the second actuator port 62 and the first actuator port 60 is connected to the drain port 58.

The pressure oil from the first pump P1 is supplied to head side oil chambers of the cylinders C2 to C5 via the actuating oil sending oil path 54→actuating oil flow passage 70→first flow path 71*a* of the communicating path 71→third flow path 71*c* of the communicating path 71→second actuator oil path 61, and the oil in the bottom side oil chambers of the cylinders C2 to C5 is discharged to flow into the drain line 24 to perform a lowering operation in the case of the boom 13, to perform an arm dump operation in the case of the arm 14, to perform a bucket-dump operation in the case of the bucket 15 and to perform a swinging operation in the other of the left and right sides in the case of the swing bracket 12.

Next, a function of the load sensing system is described.

In the case where the first flow path switching valve V11 is in the confluent position 19, when the directional switching valves DV1 to DV4 of the swing control valve V1, bucket control valve V2, arm control valve V3 and boom control valve V4 are in the neutral position 50, the discharge pressure of the first pump P1 rises up, in the case where a difference between the PPS signal pressure and the PLS signal pressure (which is zero at this time) becomes larger than a control differential pressure, a flow rate of the first pump P1 is controlled in a direction to reduce a discharge quantity and the unload valve V9 is opened to drop the discharge oil (actuating oil of the front working system supply line 18) from the first pump P1 into a tank T. Thus, in this state, the discharge pressure of the first pump P1 becomes a pressure to be set by the unload valve V9, whereby the discharge flow rate of the first pump P1 becomes the minimum discharge quantity.

In the case where the first flow path switching valve V11 is in the confluent position 19, in the case of solely operating the boom control valve V4, the load sensing system functions as follows.

In the case where the spool of the directional switching valve DV4 of the boom control valve V4 is moved to the direction to be switched from the neutral position 50 to the first switching position 51 or second switching position 52, the pressure oil from the first pump P1 flows into the boom cylinder C3, and the load pressure acting on the boom cylinder C3 is transmitted to the load pressure detection line 48 via a load pressure introduction path 74→first load pressure flow passage 77→load pressure transmission oil path 49, whereby the load pressure acting on the boom cylinder C3 becomes the PLS signal pressure, and the PLS signal pressure is transmitted to the flow rate control part FCU via the PLS transmission line 44. Further, the PLS signal pressure (load pressure acting on the boom cylinder C3) acts on the pressure receiving part 76 in the same side as a side where the return spring 65 of the spool of the pressure compensation valve CV4 is provided via the second spool actuating oil path 75.

Then, the discharge pressure of the first pump P1 is automatically controlled so that "PPS signal pressure—PLS signal pressure" becomes a controlled differential pressure, and an unload flow rate becomes zero via the unload valve V9 and the discharge flow rate of the first pump P1 begins to increase, and the whole quantity of the discharge oil of the first pump P1 flows into the boom cylinder C3 in accordance with the operated amount of the boom control valve V4.

At the time of activating the boom control valve V4, the load pressure introduction port 68 and the load pressure outlet port 69 of the pressure compensation valve CV4 are communicated through the first load pressure flow passage 77 having no diagraph, and in the process of the discharge pressure of the first pump P1 being raise, the spool is moved to the direction to be switched to the full stroke position 64 by a pressure rising in the first spool actuating oil path 72. Then, at the time of actuation after activating the boom control valve V4, the spool is switched from the first load pressure floe passage 77 to the second load pressure flow passage 78, whereby the load pressure introduction port 68 and the load pressure outlet port 69 are communicated through the second load pressure flow passage 78 having a diaphragm 79.

Further, during the actuation of the boom control valve V4 after activated, the pressure rising in the first spool actuating oil path 72 is larger than the sum of the PLS signal pressure and the return spring 65, and the spool of the pressure compensation valve CV4 becomes the full stroke, whereby the pressure compensation valve CV4 is maintained in the full stroke position 64 during the actuation of the boom control valve V4.

At the time of solely operating this boom control valve V4, during the actuation of the boom 13 (boom control valve V4) after activating the boom 13 (boom control valve V4), since the load pressure of the boom cylinder C3 is transmitted to the PLS transmission line 44 via the second load pressure flow passage 78 having the diaphragm 79, the transmission responsibility of the PLS signal pressure slows down due to the diaphragm 79 of this second load pressure flow passage 78 (i.e., the transmission responsibility of the PLS signal pressure is suppressed from being too much sensitive more than necessary), whereby stability of the machine body of the back hoe 1 (working machine) can be increased by suppressing the following performance of the control pressure against the first pump P1.

Further, at the time of activating the boom 13 (boom control valve V4), since the load pressure of the boom cylinder C3 is transmitted to the PLS transmission line 44 via the first load pressure flow passage 77 having no diaphragm (since there is no diaphragm effect), the control responsibility of the first pump P1 becomes high and the control pressure instantly follows and a quick responsibility is exerted.

That is, in the present invention, the responsibility at the time of activating the boom control valve V4 is improved while the stability of the machine body is fully ensured during the actuation of the boom control valve V4 after activated, whereby the responsibility at the time of activating the boom control valve V4 is improved and ensuring the responsibility at the time of activating the boom 13 and ensuring the stability of the machine body during the actuation of the boom 13 after activated can be made compatible.

Further, as in the conventional case, in the case where a constant amount of a diaphragm is adopted in an introduction portion of the actuator load pressure of the pressure compensation valve and a diaphragm effect is acted at the time of activating the boom and also during the actuation after activated, since the viscous resistance is high when oil temperature is usually low, the diaphragm effect becomes larger at the time of activation and the activating responsibility is largely lowered, but in the present embodiment, at the time of activating the boom control valve V4, since the load pressure is transmitted through the first load pressure flow passage 77 having no diaphragm, the activating responsibility at the time of low temperature can be ensured.

In the case where the first flow path switching valve V11 is in the confluent position 19, in the case of combined-controlling the boom control valve V4 with one or more of the swing control valve V1, bucket control valve V2 and arm control valve V3, the load sensing system functions as follows.

In this case, the maximum load pressure among the load pressures acting on the hydraulic cylinders C2 to C5 which are controlled by the operated control valves V1 to V4 becomes the PLS signal pressure and the PLS signal pressure acts on the pressure receiving part 76 in the same side as a side where the return spring 65 of the spools of the pressure compensation valves CV1 to CV4 is provided via the second spool actuating oil path 75, and the discharge pressure of the first pump P1 is automatically controlled so that "PPS signal pressure—PLS signal pressure" becomes a controlled differential pressure, and the whole quantity of the discharge oil of the first pump P1 flows into the operated hydraulic cylinders C2 to C5 in accordance with the operated amount of the operated control valves V1 to V4.

Further, by the pressure compensation valves CV1 to CV4, the differential pressures before and behind the spools (differential pressures between the upstream side pressure and the downstream side pressure of the spools) of the directional switching valves DV1 to DV4 of the operated control valves V1 to V4 become constant and the discharge flow rate of the first pump P1 is diverted by quantities in accordance with the operated amounts to each of the operated hydraulic cylinders C2 to C5, in spite of differences in size of the loads acting on the operated hydraulic cylinders C2 to C5.

It is noted that, in the case where the sum of the required flow rates of the operated hydraulic cylinders C2 to C5 exceeds the maximum discharge flow rate of the first pump P1, the maximum discharge quantity of the first pump P1 is proportionally distributed to each of the operated hydraulic cylinders C2 to C5.

In this case, in the case where the load of the boom cylinder C3 is the largest, the load pressure acting on the boom cylinder C3 becomes the PLS signal pressure and the discharge pressure of the first pump 21 is controlled, whereby an effect similar to the case of solely operating the boom 13 described above is attained.

Further, in the case where the boom 13 and arm 14 are operated and a load of the boom cylinder C3 is larger than that of the arm cylinder C4, the following effects can be attained.

In the case where the boom 13 and arm 14 are driven and horizontally pulled (working of pulling the arm 14 to be vertical while raising the boom 13 so that a toe of the bucket 15 moves along the ground surface), although the arm 14 is easily fallen down due to its self-weight at the time of activating the boom 13 and arm 14, since the responsibility of the boom control valve V4 is excellent at the time of activation, the raise of the boom 13 can be rendered to cope with the falling down of the arm 14 due to its self-weight to thereby obtain an excellent control performance of the toe of the bucket 15 (i.e., it can be prevented that the arm 14 falls down due to self-weight and the control of the toe of the bucket 15 is not stable). Also, during the actuation of the horizontal pulling after activation, since the machine body is stabilized, it is suppressed from causing such as flapping of a ground surface due to up-and-down movement of the toe of the bucket 15.

In addition, in the case of combined-operating the boom control valve V4 with the other control valves V1 to V3, in the case where the load of the boom cylinder C3 is smaller than those of the other hydraulic cylinders C2, C4 and C5, the maximum load pressure among the other hydraulic cylinders C2, C4 and C5 becomes the PLS signal pressure, there may be a case where the spool of the pressure compensation valve CV4 of the boom control valve V4 keeps a balance in an intermediate portion between the stroke start-edge position 63 and the full stroke position 64. In this case, since the load pressure of the boom cylinder C3 is not introduced (used) as a signal pressure for controlling the first pump P1, the diaphragm 79 described above has no functional relation with respect to the control of the first pump P1.

Figure 6:
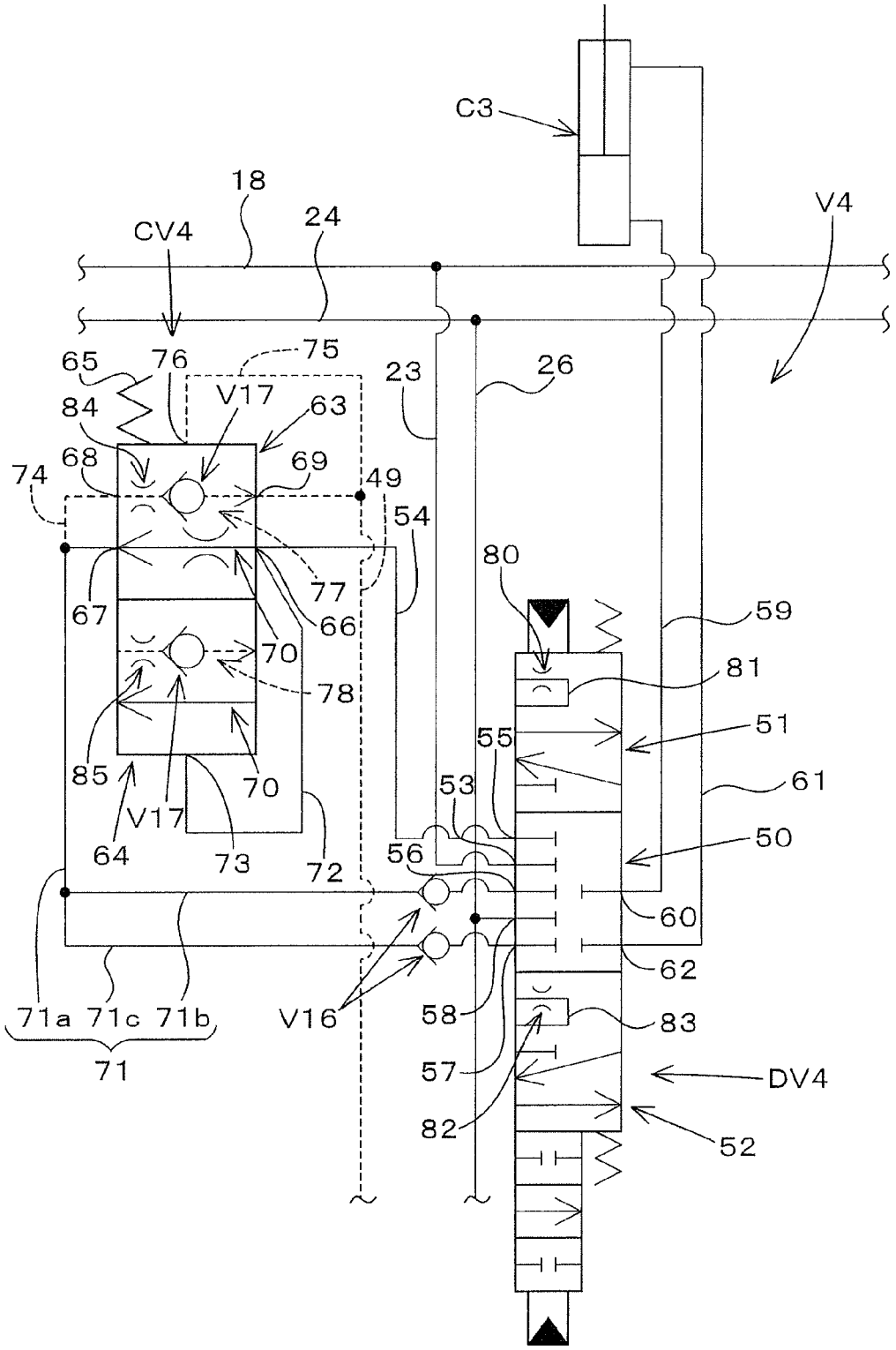
FIG. 6 is a hydraulic circuit diagram according to another embodiment.

FIG. 6 shows another embodiment.

In this embodiment, a diaphragm is provided also in the first load pressure flow passage 77 and the flow path opening area of the diaphragm of this first load pressure flow passage 77 is made larger than the flow path opening area of the diaphragm of the second load pressure flow passage 78. The other constructions are configured similarly to the embodiment described above.

Also, in this embodiment, there can be attained an effect similar to the effect mentioned above.

In the present embodiment, the first load pressure flow passage 77 and second load pressure flow passage 78 are provided in the pressure compensation valve CV4 of the boom control valve V4, and the load pressure introduction port 68 and the load pressure outlet port 69 are communicated through the first load pressure flow passage 77 at the time of activating the boom control valve V4, and during the actuation after activating the boom control valve V4, the load pressure introduction port 68 and the load pressure outlet port 69 are communicated through the second load pressure flow passage 78, however, this may be adopted to the other valves (for example, arm control valve V3).

In addition, although the present embodiment is adopted to a pressure compensation valve of a control valve for controlling a hydraulic cylinder in the present invention, it may be also adopted to a pressure compensation valve of a control valve for controlling another hydraulic actuator (hydraulic driven type actuator).

REFERENCE SIGNS LIST

44: PLS transmission line
68: Load pressure introduction port
69: Load pressure outlet port
77: First load pressure flow passage
78: Second load pressure flow passage
79: Diaphragm
84: Diaphragm
85: Diaphragm
C2: Hydraulic actuator (swing cylinder)
C3: Hydraulic actuator (boom cylinder)
C4: Hydraulic actuator (arm cylinder)
C5: Hydraulic actuator (bucket cylinder)
DV1: Directional switching valve
DV2: Directional switching valve
DV3: Directional switching valve DV4: Directional switching valve
CV1: Pressure compensation valve
CV2: Pressure compensation valve
CV3: Pressure compensation valve.
CV4: Pressure compensation valve
P1: Hydraulic pump (first pump)

The invention claimed is:

1. A working machine comprising:

a plurality of hydraulic actuators;

a variable displacement hydraulic pump for supplying pressure oil to these hydraulic actuators; and a load sensing system for controlling a discharge pressure of the hydraulic pump so as to render a differential pressure obtained by subtracting a maximum load pressure among the hydraulic actuators from a discharge pressure of the hydraulic pump to be a constant pressure, wherein the working machine is provided with: a first load pressure flow passage which introduces load pressures of the hydraulic actuators to be outputted to a PLS transmission line which transmits the maximum load pressure among the hydraulic actuators at the time of activating the hydraulic actuators; and a second load pressure flow passage which is a flow path for introducing the load pressures of the hydraulic actuators to be outputted to said PLS transmission line during operation after activations of the hydraulic actuators, and wherein a flow rate of the pressure oil therein is reduced lower than that in said first load pressure flow passage.

2. The working machine according to claim 1, comprising:

direction switching valves provided in correspondence with the respective hydraulic actuators, the direction switching valves controlling supply directions of the pressure oil discharged from said hydraulic pump to supply the pressure oil to said hydraulic actuators; and pressure compensation valves functioning so as to maintain differential pressures before and behind the direction switching valves to be constant, the pressure compensation valves provided in correspondence with the respective direction switching valves, wherein the pressure compensation valve is provided with said first load pressure flow passage and said second load pressure flow passage, whereby the first load pressure flow passage functions from a beginning of a stroke to a middle of the stroke of the pressure compensation valve and the second load pressure flow passage functions at a time of a full stroke of the pressure compensation valve.

3. The working machine according to claim 2, wherein the pressure compensation valve is provided with a load pressure introduction port introducing the load pressures of the hydraulic actuators and a load pressure outlet port outputting the load pressures of the hydraulic actuators introduced from this load pressure introduction port to the PLS transmission line, wherein said load pressure introduction port and said load pressure outlet port are communicated through the first load pressure flow passage from a beginning end of a stroke to a middle of the stroke of the pressure compensation valve, and the communication is switched at the middle of the stroke and thereafter, the load pressure introduction port and the load pressure outlet port are communicated through the second load pressure flow passage.

4. The working machine according to claim 1, wherein a diaphragm is provided in the second load pressure flow passage without providing a diaphragm in said first load pressure flow passage, whereby a flow rate of the pressure oil of the second load pressure flow passage is reduced lower than that of the first load pressure flow passage.

5. The working machine according to claim 1, wherein diaphragms are provided in both said first load pressure flow passage and said second load pressure flow passage and a flow path opening area of the diaphragm of the second load pressure flow passage is made smaller compared to a flow path opening area of the diaphragm of the first load pressure flow passage, whereby a flow rate of the pressure oil of the second load pressure flow passage is reduced lower than that of the first load pressure flow passage.

* * * * *